US009821826B2

(12) United States Patent
Yamada

(10) Patent No.: US 9,821,826 B2
(45) Date of Patent: Nov. 21, 2017

(54) TRAIN INFORMATION ANNOUNCEMENT SYSTEM

(71) Applicant: THE NIPPON SIGNAL CO., LTD., Tokyo (JP)

(72) Inventor: Takeshi Yamada, Kuki (JP)

(73) Assignee: THE NIPPON SIGNAL CO., LTD., Tokyo (JP)

( * ) Notice: Subject to any disclaimer, the term of this patent is extended or adjusted under 35 U.S.C. 154(b) by 188 days.

(21) Appl. No.: 14/227,636

(22) Filed: Mar. 27, 2014

(65) Prior Publication Data

US 2014/0209754 A1 Jul. 31, 2014

Related U.S. Application Data

(63) Continuation of application No. PCT/JP2012/074521, filed on Sep. 25, 2012.

(30) Foreign Application Priority Data

Sep. 30, 2011 (JP) ..... 2011-216710

(51) Int. Cl.

| | |
|---|---|
| ***B61L 25/02*** | (2006.01) |
| ***B61L 27/00*** | (2006.01) |
| ***B61L 25/04*** | (2006.01) |
| ***B61L 15/00*** | (2006.01) |

(52) U.S. Cl.

CPC ..... *B61L 25/02* (2013.01); *B61L 15/0027* (2013.01); *B61L 25/025* (2013.01); *B61L 25/04* (2013.01); *B61L 27/0005* (2013.01); *B61L 15/0072* (2013.01); *B61L 27/0077* (2013.01); *B61L 2027/005* (2013.01)

(58) Field of Classification Search

CPC .. B61L 2027/005; B61L 25/02; B61L 25/025; B61L 25/04; B61L 27/0005; B61L 27/0077

See application file for complete search history.

(56) References Cited

FOREIGN PATENT DOCUMENTS

| | | | |
|---|---|---|---|
| CN | 201051140 | Y | 4/2008 |
| CN | 201100956 | Y | 8/2008 |
| CN | 101917668 | A | 12/2010 |
| EP | 0 650 429 | | 5/1995 |
| JP | 62-238163 | A | 10/1987 |
| JP | 05-286440 | A | 11/1993 |
| JP | 06-247306 | A | 9/1994 |
| JP | 10-194128 | A | 7/1998 |

(Continued)

OTHER PUBLICATIONS

Office Action issued in Japanese Patent Application No. 2011-216710 dated Oct. 7, 2015 (with English Translation).

(Continued)

*Primary Examiner* — Zachary Kuhfuss
(74) *Attorney, Agent, or Firm* — Foley & Lardner LLP

(57) ABSTRACT

A train information announcement system of the present invention includes vehicle radio sets VRS1 and VRS2 which performs wireless communication, and is installed on a train 1 which moves on a railroad track R, wayside radio sets WRS1 to WRS5 arranged along the railroad track R, and an information providing means which provides train information announcements at a station at predetermined timing based on information about a train location obtained by the wireless communication between the vehicle radio sets VRS1 and VRS2 and the wayside radio sets WRS1 to WRS5.

3 Claims, 1 Drawing Sheet

(56) References Cited

FOREIGN PATENT DOCUMENTS

| | | | |
|---|---|---|---|
| JP | 2002-012150 | A | 1/2002 |
| JP | 2002-067957 | A | 3/2002 |
| JP | 2002-205647 | A | 7/2002 |
| JP | 2003-040111 | A | 2/2003 |
| JP | 2004-359156 | A | 12/2004 |
| JP | 2008-162548 | A | 7/2008 |
| JP | 2009-225585 | A | 10/2009 |

OTHER PUBLICATIONS

Office Action issued in Chinese Patent Application No. 201280047023.7 dated Jul. 15, 2015 (with English translation).
Office Action issued in corresponding Japanese application No. 2011-216710 dated Oct. 20, 2015 (with English translation).
Office Action issued in corresponding Japanese application No. 2011-216710 dated Jul. 7, 2015 (with English translation).
Chinese Office Action dated Apr. 18, 2016 issued in corresponding Chinese Application No. 201280047023.7 and its English translation thereof.
Japanese Office Action dated Mar. 14, 2016 issued in corresponding Japanese Application No. 2016-000793 and its English translation thereof.
Chinese Office Action dated Oct. 21, 2016 issued in corresponding Chinese Application No. 201280047023.7 and its English translation thereof.
Japanese Office Action dated Nov. 8, 2016 issued in corresponding Japanese Application No. 2011-216710 and its English translation thereof.
Shi, Youbao et al.: "A Fully Automatic Station Reporting Multimedia System of Train", Microcomputer Information, vol. 20, Issue 12, Dec. 2004, p. 75-76.
Zhang, Shuguang: "CRH2 EMU", China Railway Publishing House, Jul. 2008, p. 422-424.

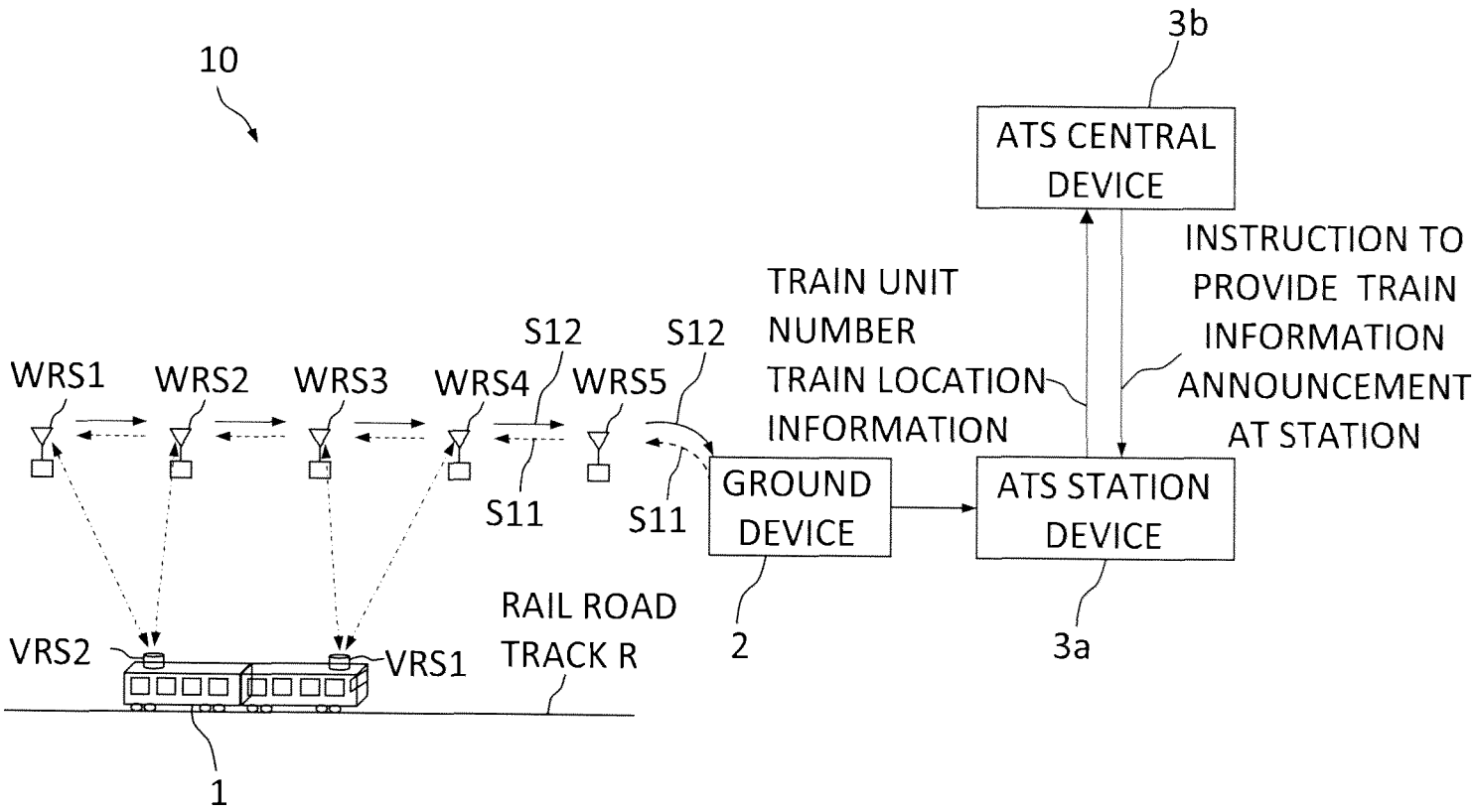
10
3b
ATS CENTRAL DEVICE
INSTRUCTION TO PROVIDE TRAIN INFORMATION ANNOUNCEMENT AT STATION
ATS STATION DEVICE
3a
TRAIN UNIT NUMBER
TRAIN LOCATION INFORMATION
GROUND DEVICE
2
S12
S11
WRS5
WRS4
WRS3
WRS2
WRS1
RAIL ROAD TRACK R
VRS1
VRS2
1

TRAIN INFORMATION ANNOUNCEMENT SYSTEM

This application is a continuation application of PCT/JP2012/074521, filed on Sep. 25, 2012.

BACKGROUND OF THE INVENTION

1. Technical Field

The present invention relates to a train information announcement system that provides arrival information and the like, at a station.

2. Description of Related Art

Conventionally, as a system for a train control device, there is known a fixed block system (for example, refer to Japanese Laid-open Patent Application Publication No. 2002-67957). This fixed block system is a system in which block sections are provided by dividing a traveling rail (track) of a train at intervals of several hundred meters, for example, to control the train in each block section.

In addition, in a case in which the abovementioned fixed block system is adopted as a system for a train control device, a train information announcement system which provides train arrival information at a station is generally configured to perform train information announcement by operating a train control device in association with such a fixed block system. Such a train information announcement system is generally configured to detect the approach of a train to a station by entering (being on a rail) of the train in a predetermined block section set before the station, and provides train information announcements such as the information of the train arrival at the station based on a detection result of the train approach.

SUMMARY OF THE INVENTION

However, the conventional train information announcement system is configured to detect the train approach in each of block sections, and in general, each block section is set to be several hundred meters, and thus, for example, the train information announcement starts at a station when the train arrives several hundred meters short of the station, which may cause a time lag between the timing of starting the train information announcement and train arrival at the station to be greater.

In view of the abovementioned problems, an object of the present invention is to provide a train information announcement system that performs train information announcement at a station at an appropriate timing.

In order to achieve the abovementioned object, a train information announcement system according to an aspect of the present invention is configured to include a vehicle radio set that performs radio communication, and is installed on a train which moves on a railroad track, a wayside radio set arranged along the railroad track, and an information providing means which provides train information announcements at a predetermined timing based on information about a train location obtained by the wireless communication between the vehicle radio set and the wayside radio set.

The train information announcement system according to an aspect of the present invention is configured to perform train information announcement at a predetermined timing based on information about a train location obtained by wireless communication between a vehicle radio set and a wayside radio set, and thus, it is possible to provide the train information announcement in real time and at a timing based on accurate train location information. Accordingly, it is possible to provide the train information announcement at an appropriate timing.

BRIEF DESCRIPTION OF THE DRAWINGS

FIG. 1 is a block diagram illustrating an embodiment of a train information announcement system according to the present invention.

DESCRIPTION OF THE PREFERRED EMBODIMENTS

Hereinafter, embodiments of the present invention will be described in detail with reference to the accompanying drawings.

FIG. 1 is a block diagram illustrating an embodiment of a train information announcement system according to the present invention.

In FIG. 1, a train information announcement system 10 of the present embodiment is configured to include a vehicle radio set VRS (VRS1, VRS2) which performs wireless communication, the vehicle radio set being installed on a train 1 moving on a railroad track R, a wayside radio set WRS (WRS1 to WRS5) arranged along the railroad track R, and an information providing means which performs information announcement of the train 1 at a station at predetermined timing based on information about a location of the train 1 obtained by the wireless communication between the vehicle radio set and the wayside radio set.

In the present embodiment, the information providing means is configured to include a ground device 2 which calculates the location of the train 1 based on a distance measurement result as the information about the train location obtained by transmission and reception between the vehicle radio set VRS (VRS1, VRS2) and the wayside radio set WRS (WRS1 to WRS5), an ATS station device 3*a*, and an ATS central device 3*b*.

The vehicle radio set VRS is installed on the train 1 moving on the railroad track R, and performs wireless communication with the wayside radio set WRS. The vehicle radio set VRS is configured to include a front vehicle radio set VRS1 mounted at a front part of the train 1 and a rear vehicle radio set VRS2 mounted at a rear part of the train 1 as illustrated in FIG. 1, for example.

Each of the vehicle radio sets VRS1 and VRS2 is configured to wirelessly communicate a train unit number as identification information of the train 1 with the wayside radio set WRS. The train unit number transmitted to the wayside radio set WRS is transmitted to the ATS central device 3*b* via the ground device 2 and the ATS station device 3*a*, for example. This train unit number is allocated to each train in advance and is controlled by being associated with a number of an arrival platform or the like in the ATS central device, for example. Furthermore, the train unit number contains information enabling identification of a train type such as a limited express train and a local train, and identification of this train unit number enables the train type to be clarified.

Furthermore, in a case in which the two vehicle radio sets (VRS1, VRS2) are provided on the train 1 as in the present embodiment, each vehicle radio set is configured to wirelessly communicate installation position information for identifying whether the vehicle radio set is installed at the front part of the train or at the rear part of the train as well as the identification information with the wayside radio set WRS. Thus, for example, it is possible to obtain the train location more accurately in consideration of a train length in the ground device 2 and the like.

The wayside radio set WRS is arranged along the railroad track R, and performs wireless communication with the vehicle radio sets VRS1 and VRS2 and the ground device 2. In the present embodiment, the wayside radio set WRS is configured to measure a distance to the train 1 (a distance between the wayside radio set WRS and the vehicle radio set VRS) by transmitting to and receiving from the vehicle radio set VRS (VRS1, VRS2). As the wayside radio set WRS, a radio set can be adopted which is used in a case of performing train control in a radio train control system called Communication Based Train Control (CBTC), that is, a moving block system, for example, and which can measure a distance between the two radio sets (between the wayside radio set WRS and the vehicle radio set VRS) with use of propagation delay time of radio waves.

In FIG. 1, as an example for simplification of the drawing, five wayside radio sets WRS1 to WRS5 are installed along the railroad track R at predetermined installation intervals. However, as a plurality of wayside radio sets WRS of which the number is determined by a distance between stations, the installation interval, and the like are appropriately installed between the respective stations.

The wayside radio sets WRS1 to WRS5 are configured to wirelessly communicate the identification information (train unit number) of the train 1 transmitted from the respective vehicle radio sets VRS1 and VRS2 and the distance measurement result to the train 1 with the ground device 2 of the information providing means. Meanwhile, in a case in which the vehicle radio sets VRS are respectively installed at the front part and the rear part of train 1 in the present embodiment, each of the vehicle radio sets VRS1 and VRS2 transmits the same identification information (train unit number).

Specifically, as illustrated in FIG. 1, for example, the wayside radio sets WRS1 to WRS5 transmit and receive a command S11 (dotted line arrow) and a report S12 (solid line arrow) to and from one another and also transmit and receive the command S11 (dotted line arrow) and the report S12 (solid line arrow) to and from the ground device 2. The command S11 is an instruction signal from the ground device 2 to the wayside radio sets WRS1 to WRS5 and contains a distance measurement command, which is a distance measuring instruction to the wayside radio sets WRS1 to WRS5. Furthermore, the report S12 is a report signal transmitted from the wayside radio sets WRS which respond to the command S11 and contains a distance measurement report, which is a distance measurement result by the wayside radio sets WRS.

Here, the wayside radio sets WRS for transmitting to and receiving from the front vehicle radio set VRS1 and the wayside radio sets WRS for transmitting to and receiving from the rear vehicle radio set VRS2 are selected by the ground device 2 to change sequentially along with travel of the train 1 as described later. For distance measurement, two wayside radio sets WRS for transmitting to and receiving from the front vehicle radio set VRS1 and two wayside radio sets WRS for transmitting to and receiving from the rear vehicle radio set VRS2, are respectively selected by the ground device 2, and each pair consisting of two wayside radio sets WRS constitutes a distance measurement radio set pair. For example, in a case of the configuration in FIG. 1, the report S12 of distance measurement obtained by the front vehicle radio set VRS1 and a distance measurement radio set pair consisting of the wayside radio sets WRS3 and WRS4, and the report S12 of distance measurement obtained by the rear vehicle radio set VRS2 and a distance measurement radio set pair consisting of the wayside radio sets WRS1 and WRS2 are transmitted to the ground device 2 via the respective wayside radio sets WRS.

The ground device 2 calculates the location of the train 1 based on the distance measurement result obtained by transmission and reception between the vehicle radio sets VRS1, VRS2 and the wayside radio sets WRS1 to WRS5. As the ground device 2, a ground device of a conventional CBTC (wireless communication train control system) can be used, for example.

The ground device 2 recognizes an initial position of the train 1 in a similar manner to that of the conventional CBTC ground device and is configured to recognize the train location in real time along with movement of the train and transmit a distance measurement command which instructs start of measuring a distance to the train 1 (vehicle radio sets VRS1, VRS2) to two neighboring wayside radio sets at the front and the rear. For example, in a state in FIG. 1, the ground device 2 selects the WRS3 and the WRS4 as the closest two wayside radio sets located in the backward and forward directions of the front vehicle radio set VRS1 and transmits the command S11 (distance measurement command) to these wayside radio sets WRS3 and WRS4, and furthermore, the ground device 2 selects the WRS1 and the WRS2 as the closest two wayside radio sets located in the backward and forward directions of the rear vehicle radio set VRS2 and transmits the command S11 (distance measurement command) to the wayside radio sets WRS1 and WRS2. The command S11 contains instruction target information for identifying to which wayside radio set the instruction is directed, for example. As illustrated in FIG. 1, each wayside radio set is configured to execute the command S11 in a case in which the command S11 sequentially propagated among the respective wayside radio sets contains the instruction target information that the instruction target is itself. Accordingly, in a case in which the wayside radio set that is not an instruction target receives the command S11, the wayside radio set just transmits the command S11 to another wayside radio set.

The ground device 2 is configured, for example, when the ground device 2 receives the distance measurement report obtained by the distance measurement radio set pair, to calculate the train location based on the distance measurement report and transmit information about the calculated train location as well as the identification information (train unit number) from the wayside radio sets WRS1 to WRS5 to the ATS central device 3*b* via the ATS station device 3*a*.

Specifically, the information providing means (ground device 2, ATS station device 3*a*, ATS central device 3*b*) is adapted to provide the train information announcement at the station at predetermined timing based on the information about the train location calculated by the ground device 2. This information providing means is configured to provide the train information announcement containing information of the train type (for example, a limited express train and a local train) determined based on the identification information (train unit number), for example. For example, the information providing means is configured to provide, at a station, information announcement of the train type and the arrival platform number and train arrival information. For example, "The limited express will soon arrive on Track 3" is announced.

Here, the predetermined timing is timing at which the train location calculated by the ground device 2 agrees with a location preset for start of the train information announcement, for example. That is, the information providing means is configured to start the train information announcement at timing at which the train location calculated by the ground device 2 agrees with the location preset for start of the train information announcement, for example. Specifically, for example, as illustrated in FIG. 1, in a case in which the front vehicle radio set VRS1 is disposed at a front side of the train 1 in a traveling direction, the ground device 2 determines whether the train location calculated based on the distance measurement result obtained between the VRS1 and the closest distance measurement radio set pair agrees with the location preset for start of the train information announcement.

The ATS station device 3*a* is installed in a station and transmits the train unit number and the train location information from the ground device 2 to the ATS central device, and on receiving an instruction to provide train information announcement, from the ATS central device based on the transmitted information, the ATS station device 3*a* actually provides the train information announcement based on the transmitted instruction.

The ATS central device 3*b* is adapted to be connected to the ATS station device 3*a* installed in the station and perform train operation control, for example, and is configured to receive the train unit number and the train location information via the ATS station device 3*a*. This ATS central device 3*b* instructs the ATS station device 3*a* to start the train information announcement at a timing at which the train location transmitted via the ATS station device 3*a* agrees with the location preset for start of the train information announcement. This location for start of the train information announcement is a location appropriately set before the station based on speed and the like of the train 1 before the station, so that time lag between the train information announcement and actual train arrival at the station may be appropriate.

The ATS central device 3*b* is also configured to perform train operation control by associating the train unit number with the arrival platform number, for example, and is configured to determine the train type and the arrival platform number based on the train unit number transmitted via the ATS station device 3*a* and instruct the ATS station device 3*a* to provide the information of the train type and the arrival platform based on the determination result as well as the train arrival information.

Next, operations of the train information announcement system 10 of the present embodiment will be described with reference to FIG. 1. It is to be noted that operations when the train 1 is traveling near the wayside radio set WRS2 will be described below.

First, the ground device 2 recognizes that the front vehicle radio set VRS1 is located between the wayside radio set WRS3 and the wayside radio set WRS4, selects the WRS3 and the WRS4 as the closest two wayside radio sets located in the backward and forward directions of the front vehicle radio set VRS1, and transmits the command S11 (distance measurement command) for the wayside radio sets WRS3 and WRS4, and the ground device 2 selects the WRS1 and the WRS2 as the closest two wayside radio sets located in the backward and forward directions of the rear vehicle radio set VRS2 and transmits the command S11 (distance measurement command) for the wayside radio sets WRS1 and WRS2. The command S11 is propagated among the respective wayside radio sets.

Here, as illustrated in FIG. 1, each of the wayside radio sets WRS1 to WRS5 executes the distance measurement command in a case in which the command S11 sequentially propagated contains the instruction target information that the instruction target is itself. The distance measurement radio set pair WRS3-WRS4 executes wireless communication with the front vehicle radio set VRS1 since the command S11 contains the instruction target information that the instruction targets are themselves, measures distances between the radio sets (WRS3-VRS1, WRS4-VRS1), respectively, based on propagation delay time of radio waves thereof, and receives the train unit number and the like from the front vehicle radio set VRS1. The distance measurement radio set pair WRS3-WRS4 then transmits the report S12 of the distance measurement result and the train unit number and the like to the ground device 2 via the respective wayside radio sets WRS.

Similarly, the distance measurement radio set pair WRS1-WRS2 executes wireless communication with the rear vehicle radio set VRS2 since the command S11 contains the instruction target information that the instruction targets are themselves, measures distances between the radio sets (WRS1-VRS2, WRS2-VRS2), respectively, based on propagation delay time of radio waves thereof, and receives the train unit number and the like from the rear vehicle radio set VRS2. The distance measurement radio set pair WRS1-WRS2 then transmits the report S12 of the distance measurement result and the train unit number and the like to the ground device 2 via the respective wayside radio sets WRS.

Subsequently, on receiving the report S12 and the like obtained from the distance measurement radio set pair, the ground device 2 calculates the train location based on the report and transmits the calculated train location information and the train unit number to the ATS central device 3*b* via the ATS station device 3*a*.

The ATS central device 3*b* determines whether or not the train location transmitted from the ATS station device 3*a* (for example, the train location calculated based on the distance measurement result obtained between the VRS1 and the wayside radio sets) agrees with the location preset for start of the train information announcement. Here, when the train 1 travels further, and the train location agrees with the location for start of the train information announcement, the ATS central device 3*b* instructs the ATS station device 3*a* to start the train information announcement.

On receiving the instruction to start the train information announcement from the ATS central device 3*b*, the ATS station device 3*a* provides the train information announcement such as "The limited express will soon arrive on Track 3" based on the determination result of the train type and the arrival platform number by the ATS central device 3*b*.

The train information announcement system 10 of the abovementioned embodiment is configured to provide train information announcements at predetermined timings based on information about a train location calculated based on a distance measurement result obtained by transmission and reception between the wayside radio sets WRS1 to WRS5 and the vehicle radio sets VRS1 and VRS2, and thus, it is possible to provide the train information announcement in real time and at a timing based on accurate train location information. Accordingly, it is possible to provide the train information announcement at appropriate timing.

Furthermore, as in the present embodiment, the train information announcement system 10 is configured to provide train 1 with two vehicle radio sets VRS and calculate the train location with use of the distance measurement result obtained between the respective vehicle radio sets VRS1, VRS2 and the wayside radio sets WRS, and thus, the ground device 2 can calculate the train location with high precision in consideration of the entire train length. Meanwhile, although a case in which two vehicle radio sets VRS are installed at the front part and the rear part of the train 1 has been described above, the present invention is not limited to this, and one vehicle radio set may be installed at the front part of the train 1 in the traveling direction.

Furthermore, as in the present embodiment, the vehicle radio set VRS is configured to transmit the identification information (train unit number) of the train to the ATS station device 3*a*, for example, via the wayside radio sets WRS and the ground device 2, and thus, it is possible to easily determine the train type based on the transmitted train unit number and provide train information announcement of the train type. In particular, in providing train information announcements for a train type regarding, for example, a train entering from another line section, an operator or the like for operation control does not need to manually enter information about the train type into the ATS central device 3*b*, and thus, workload of the operator or the like can be reduced. It is to be noted that the identification information of the train is not limited to the train unit number but has only to be information containing information capable of identifying the train type such as a limited express train and a local train.

In the present embodiment, although a case in which the information providing means (ATS station device 3*a*, ATS central device 3*b*) announces the information of the train type and the arrival platform number as well as the train arrival information that has been described above, the present invention is not limited to this, and for example, the information providing means may announce only the train arrival information and the train type information, may announce only the train arrival information and the information of the arrival platform number, or may announce only the train arrival information.

Furthermore, the information providing means (ATS station device 3*a*, ATS central device 3*b*) can not only provide information about the train arriving at the station but can also provide information of a train passing the station and train delay information in another line section or the like. In a case of providing the passing information as well, locations at which the train information announcement is started are provided for the arrival information and for the passing information, and the location for the passing information is set in accordance with the train speed at the time of the train passing. Furthermore, the delay information may be provided together with the arrival information, or the delay information may be provided by an operator or the like of the ATS central device, if necessary.

In the present embodiment, the information providing means is configured to include the ground device 2, the ATS station device 3*a*, and the ATS central device 3*b*, that is, the ground device 2 and the ATS station device 3*a* are linked with the ATS central device 3*b*, has been described above; however, the present invention is not limited to this, and for example, the information providing means may be configured to include only the ground device 2 and the ATS station device 3*a*. In this case, for example, the ATS station device 3*a* is configured to determine whether the train location calculated by the ground device 2 agrees with the location for start of the train information announcement and has a function of train operation control and a function of determining the train type and the arrival platform number based on the train unit number.

In the present embodiment, the predetermined timing is a timing at which the train location calculated by the ground device 2 agrees with the location preset for start of the train information announcement, that is, the train information announcement is provided at a timing at which the train location calculated by the ground device 2 agrees with the location preset for start of the train information announcement; however, the present invention is not limited to this, and the train information announcement may be provided at a timing at which a preset predetermined period has elapsed after the train location calculated by the ground device 2 agrees with the location preset for start of the train information announcement.

Furthermore, in the description of the present embodiment, although measurement of the distance between the train and the wayside radio set WRS is performed by the wayside radio set WRS, the present invention is not limited to this, and the measurement may be performed by the vehicle radio set VRS. In this case, the vehicle radio set VRS is configured to transmit the distance measurement result as well as the train unit number to the wayside radio set WRS.

Furthermore, the identification information of the train is not limited to the train unit number but may be any information from which the train type such as a limited express train and a local train is identified and which is transmitted in wireless communication.

Meanwhile, in the present embodiment, the information providing means provides the information announcement of the train 1 at predetermined timing based on the train location calculated based on the distance measurement result as information about the train location obtained by performing wireless communication between the vehicle radio set and the wayside radio set, that is, radio distance measurement, has been described above; however, the present invention is not limited to this. For example, a GPS receiver may be provided on the train 1, and the information providing means may be configured to provide the information announcement of the train 1 at predetermined timing based on GPS location information, which is obtained by this GPS receiver, as information about the train location transmitted and obtained by wireless communication between the vehicle radio set and the wayside radio set.

In this manner, the train information announcement system 10 according to the present invention is configured to perform the train information announcement at the predetermined timing based on information about a train location obtained by wireless communication between the vehicle radio set and the wayside radio set, and thus, it is possible to provide the train information announcement in real time and at a timing based on accurate train location information. Accordingly, it is possible to provide the train information announcement at an appropriate timing.

It should be noted that the entire contents of Japanese Patent Application No. 2011-216710, filed on Sep. 30, 2011, on which convention priority is claimed, is incorporated herein by reference.

It should also be understood that many modifications and variations of the described embodiments of the invention will be apparent to a person having an ordinary skill in the art without departing from the spirit and scope of the present invention as claimed in the appended claims.

What is claimed is:

1. A train information announcement system comprising:

a vehicle radio set that performs wireless communication and is installed on a train that moves on a railroad track;

a plurality of wayside radio sets that are arranged along the railroad track at predetermined installation intervals; and an information providing means that selects closest two wayside radio sets located in backward and forward directions of the vehicle radio set from the plurality of wayside radio sets along with movement of the train, transmits a distance measurement command which instructs measuring a distance to the train to the two wayside radio sets that are selected, receives a distance measurement report of a distance measurement result obtained by transmission and reception between the vehicle radio set and the two wayside radio sets that are selected, calculates a location of the train based on the distance measurement report, and provides, at a timing at which the location of the train that is calculated agrees with a location preset for each of arrival information about a train arriving at the station and passing information about a train passing the station, announcement for the train arriving at the station or passing the station, at the station.

2. The train information announcement system according to claim 1, wherein the vehicle radio set wirelessly communicates identification information of the train to the two selected wayside radio sets, wherein at least one of the two wayside radio sets wirelessly communicates the identification information of the train transmitted from the vehicle radio set and the result of the distance measurement between the train and the two wayside radio sets to the information providing means, and wherein the information providing means provides the train information announcement containing information of a train type determined based on the identification information of the train.

3. The train information announcement system according to claim 2, wherein the identification information of the train is a train unit number.

* * * * *